US007665438B2

(12) United States Patent
Hirning et al.

(10) Patent No.: US 7,665,438 B2
(45) Date of Patent: Feb. 23, 2010

(54) STARTER DEVICE FOR AN INTERNAL COMBUSTION ENGINE HAVING SEPARATE ENGAGING PROCESS AND STARTING PROCESS

(75) Inventors: Reiner Hirning, Eberdingen-Hochdorf (DE); Karl-Otto Schmidt, Keltern (DE); Sven Hartmann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 231 days.

(21) Appl. No.: 11/659,868

(22) PCT Filed: Jul. 5, 2005

(86) PCT No.: PCT/EP2005/053186

§ 371 (c)(1),
(2), (4) Date: Sep. 4, 2007

(87) PCT Pub. No.: WO2006/018350

PCT Pub. Date: Feb. 23, 2006

(65) Prior Publication Data

US 2008/0127927 A1 Jun. 5, 2008

(30) Foreign Application Priority Data

Aug. 17, 2004 (DE) ..... 10 2004 039 757
Jan. 31, 2005 (DE) ..... 10 2005 004 326

(51) Int. Cl.
*F02N 11/08* (2006.01)

(52) U.S. Cl. ..... 123/179.3; 701/113

(58) Field of Classification Search ..... 123/179.3, 123/179.4; 290/38 C, 38 R, 38 E; 701/113
See application file for complete search history.

(56) References Cited

U.S. PATENT DOCUMENTS

| | | | | |
|---|---|---|---|---|
| 5,622,148 | A * | 4/1997 | Xue et al. | 290/38 R |
| 6,456,034 | B1 * | 9/2002 | Vilou | 123/179.3 |
| 6,516,767 | B1 * | 2/2003 | Maillet et al. | 123/179.3 |
| 6,634,332 | B2 * | 10/2003 | Saito et al. | 123/179.3 |
| 6,651,603 | B2 * | 11/2003 | Osada et al. | 123/179.3 |
| 6,752,111 | B2 * | 6/2004 | Osada et al. | 123/179.3 |
| 2002/0014216 | A1 * | 2/2002 | Boegner et al. | 123/179.3 |
| 2003/0070645 | A1 * | 4/2003 | Osada et al. | 123/179.3 |

FOREIGN PATENT DOCUMENTS

DE 199 58 098 6/2001

(Continued)

OTHER PUBLICATIONS

Patent Abstracts of Japan, vol. 2000, No. 13, Feb. 5, 2001 & JP 2000 291517 (Toyota Motor Corp.), Oct. 17, 2000.
Patent Abstracts of Japan, vol. 1999, No. 05, May 31, 1999 & JP 11 030173 (Hitachi Ltd.), Feb. 2, 1999.

*Primary Examiner*—Stephen K Cronin
*Assistant Examiner*—Arnold Castro
(74) *Attorney, Agent, or Firm*—Kenyon & Kenyon LLP

(57) ABSTRACT

A device for starting an internal combustion engine of a motor vehicle includes a starter motor having an actuator for engaging a pinion, drivable by the starter motor, with a ring gear, and a control unit which activates a switching output stage associated with the actuator and a switching output stage associated with the starter motor. The starting time of the internal combustion engine is substantially reduced by providing the starter device with a control unit.

17 Claims, 2 Drawing Sheets

FOREIGN PATENT DOCUMENTS

| | | | | |
|---|---|---|---|---|
| EP | 0 848 159 | | | 6/1998 |
| EP | 1 041 275 | | | 10/2000 |
| EP | 1 113 169 | | | 7/2001 |
| JP | 11030173 | A | * | 2/1999 |
| JP | 2000314364 | | | 11/2000 |
| JP | 2004044393 | | | 2/2004 |
| JP | 2004044435 | | | 2/2004 |

* cited by examiner

STARTER DEVICE FOR AN INTERNAL COMBUSTION ENGINE HAVING SEPARATE ENGAGING PROCESS AND STARTING PROCESS

BACKGROUND OF THE INVENTION

1. Field of the Invention

The present invention relates to a device for starting an internal combustion engine of a motor vehicle.

2. Description of Related Art

Internal combustion engines of motor vehicles are usually started by a starter motor which is supplied with electrical current from a vehicle battery. Known starter motors include a solenoid switch via which a pinion that is driven by the starter motor is engaged with a ring gear attached to a flywheel of the internal combustion engine. In the starting position the ignition lock closes an electric circuit which causes current to flow through the solenoid switch, so that the pinion is moved forward against the ring gear via an engaging lever. As a rule, a tooth-to-tooth position occurs in which the pinion must be rotated in order to engage in a gap in the ring gear. Toward the end of the relay path the solenoid switch closes the main electrical circuit of the starter motor via a contact, as the result of which current flows through the starter motor and the starter motor starts to rotate. The pinion fully engages with the ring gear immediately after rotation starts. The starter motor thus drives the pinion, and via the pinion drives the ring gear of the internal combustion engine, which likewise starts to rotate. When the ignition key is released the relay circuit is interrupted, and the pinion is disengaged via a restoring spring.

It is known from published European patent document EP 0848159 to separately activate the solenoid switch and the starter motor via an electronic control device and two switching output stages in order to carry out the engaging process independently of the actual starting process. It is thus possible, for example, for the pinion to engage when the internal combustion engine is at a standstill, and for the actual starting process to be carried out only after a start request (turning of the ignition key) by the driver. This process is referred to as "pre-engagement." In this manner, restarting of the vehicle may be accelerated, in particular during start-stop operation of the motor vehicle, since the pinion is already in the engaged position. However, the early engagement of the pinion when the internal combustion engine is at a standstill has the disadvantage that the engaging process produces a clearly audible clicking sound when the solenoid switch activates and the pinion strikes the ring gear axially, or, during engagement, rotates against a tooth flank of the ring gear. This is irritating and unpleasant for the driver.

It is therefore an object of the present invention to provide a device for starting an internal combustion engine in which the engagement noise level produced by the starter is significantly lower, and to further shorten the starting process.

A BRIEF SUMMARY OF THE INVENTION

This object is achieved according to the present invention by supplying current to the actuator for the engaging device (for example, the pull-in winding of a solenoid switch or an electric motor) only partially instead of completely when the pinion is engaged, and for this purpose driving the actuator for the engaging device as well as the starter motor by a current that is suitably adjusted, for example by clocking. As a result, the engaging device operates more slowly, and the pinion advances more slowly than when under full current, thus reducing the clicking noise when the pinion strikes the ring gear. The described additional short-term flow of current through the starter motor causes the pinion to fully engage with the ring gear. Since this occurs under low current, during engagement the pinion strikes the tooth flank of the ring gear at a low rotational speed, and therefore with low noise.

The engagement noise is particularly unnoticeable when current flows through the solenoid switch, while the internal combustion engine is still rotating and the engagement noise is masked by the engine noise. For this reason the solenoid switch is activated during a coasting phase of the internal combustion engine, for example when the engine during start-stop operation of the vehicle has been automatically shut off upon stopping at a traffic light, and the engine speed is below a predetermined threshold. The engine speed threshold is well below the idling speed of the engine in order to keep the wear on the engaging device as low as possible.

Starter motors generally require a very high starting current, which may result in voltage dips in the vehicle electrical system. The starter motor is therefore preferably operated by the control unit in smooth-start mode to prevent excessive stress on the vehicle electrical system. For this purpose the switching output stage for the starter motor is preferably also activated by use of a suitably adjusted current, for example by clocking. This type of actuation of the main current for the starter motor limits the power consumption and thus avoids or reduces voltage dips in the vehicle electrical system.

To prevent excessive load on the vehicle electrical system, the starter motor may also be driven at a different power level as a function of the capacity of the vehicle electrical system. The capacity of the vehicle electrical system may be determined, for example, by monitoring the system voltage or by analyzing the battery state. If the vehicle electrical system has a low capacity, the main current for the starter motor may thus be reduced, or the starting process may be completely interrupted.

The pre-engagement according to the present invention by separating the engaging process from the actual starting process, i.e., the cranking process, also allows the crankshaft, when the internal combustion engine is not operating, to be brought into an optimal position for starting the internal combustion engine. To this end, the starter motor need only be appropriately activated and brought into the intended position by the control unit, the position of the crankshaft being detected by sensors. When the crankshaft is located in an optimal position before the actual cranking, the start time may be shortened even more.

The switching output stages for the actuator for the engaging device and for the starter motor are preferably implemented as semiconductor switches, in particular transistors.

The control unit is connected via a bus system to a further control device which, for example, detects the intent of the driver during start-stop operation of the vehicle, or determines the performance state of the vehicle electrical system and communicates with the control unit. Conversely, the control unit may communicate possible malfunctions in the relay contact or the switching output stages for the actuator and the electric motor. These malfunctions are detected via current or voltage measurements at specific points in time, and undergo plausibility checks in the control unit.

DETAILED DESCRIPTION OF THE INVENTION

Figure 1:
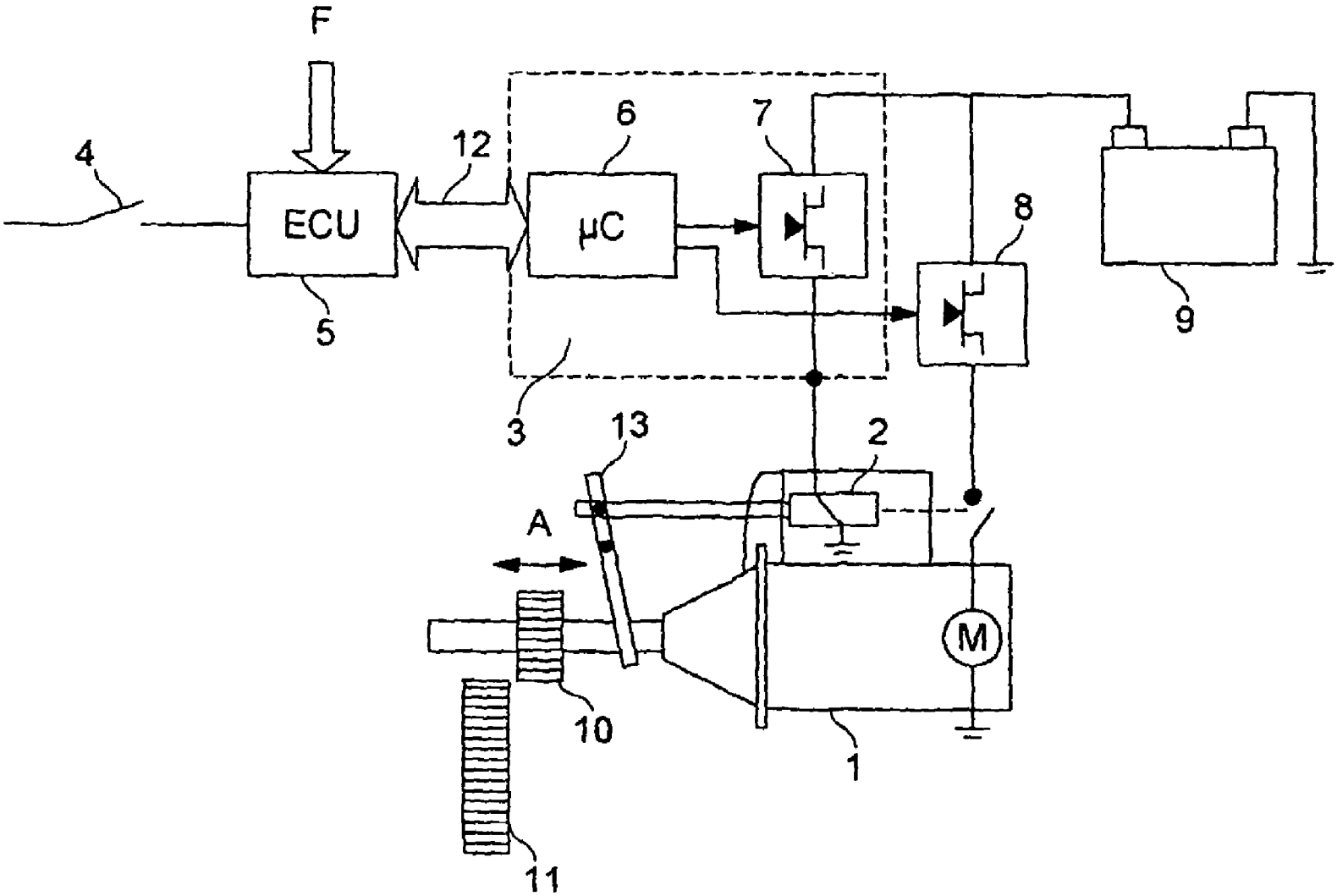
FIG. 1 shows a schematic block diagram of a start-stop system according to one example embodiment of the present invention.

FIG. 1 shows a schematic illustration of a starter device of a start-stop system for starting the internal combustion engine of a motor vehicle. The starter device essentially includes a starter motor 1 having an actuator 2 for engaging a pinion 10 driven by starter motor 1, with a ring gear 11 situated on the flywheel of the internal combustion engine (not shown). In the engaged position, starter motor 1 is energized and the internal combustion engine is thus started. In this case actuator 2 is illustrated as a solenoid switch, but could also be implemented as a small electric motor, for example.

The starter device includes two switching output stages 8 and 7 which are associated with starter motor 1 and solenoid switch 2, respectively. Switching output stage 8 switches the main current for starter motor 1, and switching output stage 7 switches the current for the pull-in winding of solenoid switch 2. For this purpose, switching output stages 7, 8 each include at least one transistor switch, the control leads of which are connected to a control unit 6 and are activated by same. In this manner, actuator 2 for engaging device (2, 10, 13) may be activated independently or separately from starter motor 1, in particular by use of a suitably adjusted current, for example a clocked current, and the engaging process may thus be carried out independently from the actual starting process with respect to time.

First switching output stage 7 is integrated together with control unit 6 in a control device 3. In contrast, the switching output stage of starter motor 1 is implemented separately due to the fact that it must switch high currents.

The circuit shown allows pinion 10 to engage with ring gear 11 during a start-stop operation of the vehicle, for example when the internal combustion engine is still coasting, after the internal combustion engine has been automatically shut off. As a result, the engine noise is superimposed on the engagement noise, and therefore the engagement noise is barely audible to the driver and has no disturbing effect. Optionally, the pinion may also be engaged when the internal combustion engine is not operating.

The engaging process is performed in a particularly smooth manner (at low speed), for example by clocking a suitable activation of actuator 2 and of starter motor 1, thereby reducing the engagement noise.

For the case that pinion 10 does not immediately fall into a tooth space of ring gear 11, but instead axially strikes the end face of a tooth of ring gear 11, pinion 10 must be rotated with respect to the ring gear to allow the pinion to continue moving forward. For this purpose, starter motor 1 is started smoothly, for example by clocking of an appropriate activation of switching output stage 8. Slow cranking of starter motor 1 also greatly reduces the wear of pinion 10 and ring gear 11.

Upon recognition of a start request by the driver (for example, as a result of the driver activating the gas pedal), starter motor 1 is driven with greater power in order to start the internal combustion engine. In this case, the intent of the driver to start is recognized by an additional control device 5 which evaluates various sensor signals for a sensor system for vehicle state recognition which may, for example, recognize the clutch activation, brake activation, position of the gear selector lever, and/or the position of ignition key 4. The sensor signals are combined as input variable F. If control device 5 detects a start or stop condition, a corresponding state signal is transmitted via a bus system 12 to control unit 6.

In the event of an intent of the driver to start, starter motor 1 preferably is not fully energized until sufficient energy is available in the vehicle electrical system. Otherwise, starter motor 1 is operated at lower power and the main current is correspondingly reduced by suitable activation, via clocking, for example, of switching output stage 8. This also prevents short-term intense voltage dips which otherwise occur when starter motor 1 is switched on. For determining the capacity of the vehicle electrical system, a battery state recognition device may be provided which detects the state of charge (SOC) or the state of health (SOH) of a battery 9. The capacity of battery 9 is then taken into account by control unit 6.

The vehicle electrical system illustrated in FIG. 1 together with all electrical consumers is supplied with electrical power by a starter battery 9. One power terminal for each of switching output stages 7, 8 is connected to a supply line for the vehicle electrical system.

Figure 2:
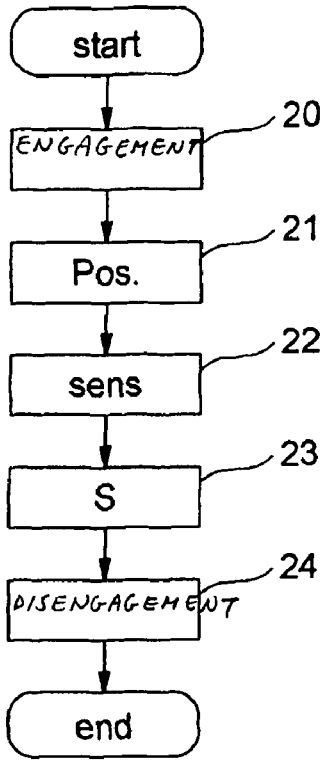
FIG. 2 shows a flowchart of the method steps when starting an internal combustion engine during a start-stop operation.

FIG. 2 shows the method steps when starting an internal combustion engine during a start-stop operation. Block 20 indicates an engaging process in which pinion 10 is moved forward in the direction of arrow A as the result of clocked current flow through actuator 2 (a solenoid switch, for example), and, if necessary, starter motor 1 is started in smooth mode if pinion 10 does not immediately go into the engaged position. In the engaged position the teeth of pinion 10 engage with the spaces in ring gear 11.

In step 21 the crankshaft of the internal combustion engine (not shown) is positioned and is brought into an optimal position for starting. For this purpose, starter motor 1 is activated in a clocked manner and is cranked until the crankshaft has reached the setpoint position. This is recognized by sensors in step 22. In this phase the intent of the driver is continuously monitored, and when an intent to start is detected, for example due to activation of the gas pedal, after the driver's door is opened, or as the result of seat occupancy recognition, starter motor 1 is cranked in step 23. As soon as the internal combustion engine is running independently, pinion 10 is disengaged in step 24.

It is also possible for control unit 6 to activate actuator 2 and starter motor 1 in such a way that pinion 10 engages with ring gear 11 before a starting process for the vehicle, and even before the driver has expressed a new intent to start. In principle, actuator 2 and starter motor 1 may also be separately activated in a clocked manner by control unit 6 by use of a suitably adjusted current.

Figure 3:
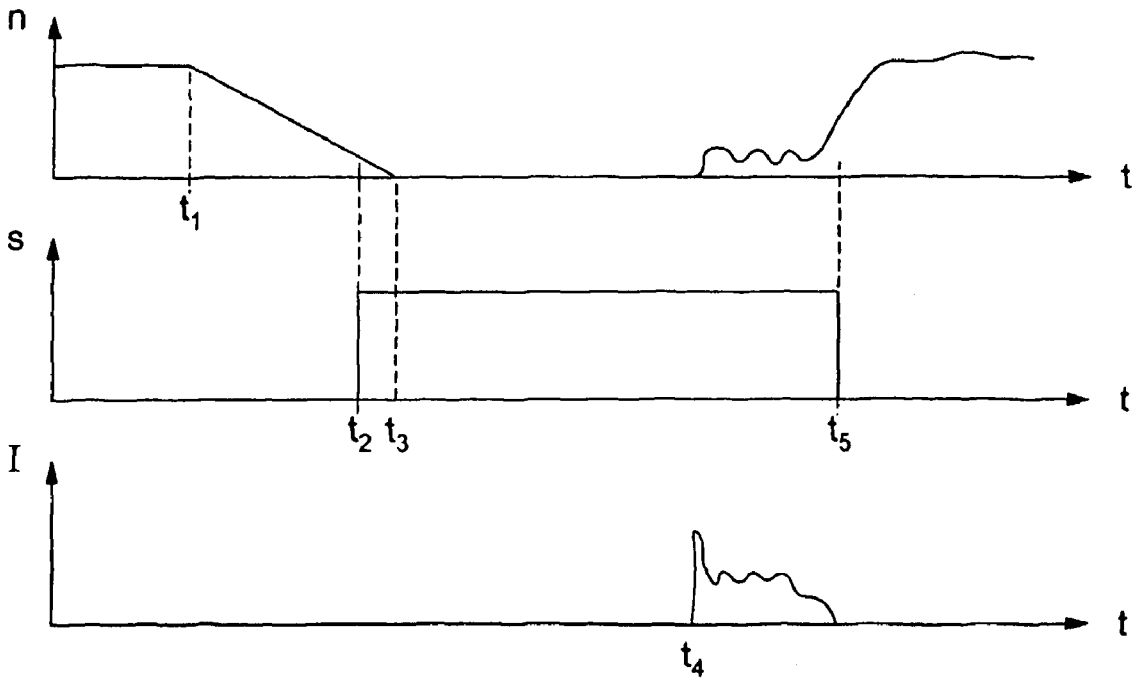
FIG. 3 shows a time diagram of the essential variables during a start-stop operation.

FIG. 3 shows a time diagram of the essential variables for a start-stop operation of the vehicle. FIG. 3 shows engine speed n, engagement path s, and the current in starter motor 1.

The illustrated start-stop cycle begins with the internal combustion engine running in idle mode, the internal combustion engine being automatically shut off at point in time t1 (for example, because the driver has stopped at a traffic light). The internal combustion engine then coasts, and engine speed n is reduced. Shortly before the internal combustion engine completely stops operation at point in time t2, pinion 10 engages with the ring gear, as shown in the middle diagram of FIG. 3. At point in time t3 the internal combustion engine completely stops.

Pinion 10 subsequently remains engaged, and as previously described is driven for positioning the crankshaft. At point in time t4 control unit 6 detects an intent of the driver to start, and correspondingly activates starter motor 1. Associated starting current I of the starter motor is illustrated in the bottom diagram of FIG. 3. After several revolutions of the internal combustion engine, it runs independently, so that at point in time t5 pinion 10 is once again disengaged. This process repeats in every start-stop cycle.

The present invention has been described above for a start-stop system, but is not limited to such start-stop systems and may also be used in conventional starter devices for an internal combustion engine when a separate engaging process and starting process are to be implemented.

What is claimed is:

1. A device for starting an internal combustion engine of a motor vehicle, comprising:

a starter motor;

an engaging device including an actuator for engaging a pinion driven by the starter motor;

a ring gear configured to be selectively engaged with the pinion; and a control unit configured to activate a first switching output stage associated with the actuator and a second switching output stage associated with the starter motor;

wherein:

the actuator and the starter motor are activated separately by the control unit, and in a clocked manner, by use of a selectively adjusted current to engage the pinion with the ring gear; and the control unit activates the actuator in such a way that the actuator is brought into an engaged position during a coasting operation of the internal combustion engine.

2. The device as recited in claim 1, wherein the control unit activates the starter motor as a function of a capacity of a vehicle electrical system.

3. The device as recited in claim 1, wherein the first and second switching output stages includes transistor switches.

4. The device as recited in claim 1, wherein the control unit is connected to a further control device via a bus system.

5. The device as recited in claim 1, wherein the control unit activates the starter motor when the internal combustion engine is at a standstill, so that the crankshaft is brought into an optimum position for starting the internal combustion engine.

6. The device as recited in claim 1, wherein the control unit is configured such that the pinion engages the ring gear during each coasting operation of the internal combustion engine in a start-stop operation of the engine, the coasting operation corresponding to a period subsequent to a respective stop and before a respective starting process, and before a driver has expressed an intent to start the engine.

7. The device as recited in claim 1, wherein the pinion engages the ring gear when a starting process for the engine is anticipated by one of an opening of a driver-side door of the vehicle a recognition of a seat occupancy.

8. The device as recited in claim 1, wherein the coasting operation is subsequent to a stopping of the motor vehicle and prior to an expression by a driver of an intent to start the engine subsequent to the stopping of the motor vehicle.

9. A device for starting an internal combustion engine of a motor vehicle, comprising:

a starter motor;

an engaging device including an actuator for engaging a pinion driven by the starter motor;

a ring gear configured to be selectively engaged with the pinion; and a control unit configured to activate a first switching output stage associated with the actuator and a second switching output stage associated with the starter motor;

wherein:

the actuator and the starter motor are activated separately by the control unit, and in a clocked manner, by use of a selectively adjusted current to engage the pinion with the ring gear; and the control unit is:

connected to a further control device via a bus system; and configured to detect a malfunction via at least one of current measurements and voltage measurements at one of relay contacts and the first and second switching output stages by use of plausibility checks, and communicate the detected malfunction via the bus system.

10. The device as recited in claim 9, wherein the control unit activates the actuator and the starter motor in such a way that the pinion engages the ring gear in response to a predetermined event, that occurs before a starting process for the engine and before a driver has expressed an intent to start the engine.

11. The device as recited in claim 9, wherein the control unit activates the starter motor when the internal combustion engine is at a standstill, so that the crankshaft is brought into an optimum position for starting the internal combustion engine.

12. The device as recited in claim 9, wherein, responsive to a predetermined period subsequent to a respective stop, before a respective starting process, and before a driver has expressed an intent to start the engine, in each start-stop operation of the engine, the control unit activates the actuator in such a way that the actuator is brought into an engaged position, the pinion engaging the ring gear when the actuator is brought into the engaged position.

13. The device as recited in claim 12, wherein the predetermined period is a coasting period of the internal combustion engine.

14. The device as recited in claim 9, wherein the control unit activates the actuator in such a way that the actuator is brought into an engaged position during each coasting operation of the internal combustion engine in a start-stop operation of the engine, the coasting operation corresponding to a period subsequent to a respective stop and before a respective starting process, and before a driver has expressed an intent to start the engine, the pinion engaging the ring gear when the actuator is brought into the engaged position.

15. The device as recited in claim 9, wherein the pinion engages the ring gear when a starting process for the engine is anticipated by one of an opening of a driver-side door of the vehicle a recognition of a seat occupancy.

16. The device as recited in claim 9, wherein the control unit activates the starter motor as a function of a capacity of a vehicle electrical system.

17. The device as recited in claim 9, wherein the first and second switching output stages includes transistor switches.

* * * * *

UNITED STATES PATENT AND TRADEMARK OFFICE

CERTIFICATE OF CORRECTION

PATENT NO. : 7,665,438 B2
APPLICATION NO. : 11/659868
DATED : February 23, 2010
INVENTOR(S) : Hirning et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 234 days.

Signed and Sealed this

Seventh Day of December, 2010

David J. Kappos

David J. Kappos
*Director of the United States Patent and Trademark Office*